US006523228B1

(12) United States Patent
Benoit

(10) Patent No.: US 6,523,228 B1
(45) Date of Patent: Feb. 25, 2003

(54) TAMPER-PROOF TIE

(75) Inventor: James C. Benoit, Needham, MA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/697,457

(22) Filed: Oct. 26, 2000

(51) Int. Cl.[7] ..... B65D 63/00; A43C 11/00
(52) U.S. Cl. ..... 24/16 PB; 24/16 R
(58) Field of Search ..... 24/16 PB, 17 A, 24/17 B, 17 AB, 30.5 P; 70/14–18, 57.1; 128/869, 879; 248/74.1, 74.3; 292/317–322

(56) References Cited

U.S. PATENT DOCUMENTS

| | | | | | |
|---|---|---|---|---|---|
| 1,188,372 | A | * | 6/1916 | June | 292/322 |
| 1,587,754 | A | * | 6/1926 | Brune, Sr. | 292/322 |
| 3,556,575 | A | | 1/1971 | Farkas | 24/16 PB |
| 3,712,655 | A | | 1/1973 | Fuehrer | 24/16 PB |
| 3,766,608 | A | | 10/1973 | Fay | 24/16 PB |
| 3,816,879 | A | | 6/1974 | Merser et al. | 24/16 PB |
| 3,954,294 | A | * | 5/1976 | Iwamoto et al. | 292/318 |
| 4,003,106 | A | | 1/1977 | Schumacher et al. | 24/16 PB |
| 4,240,183 | A | | 12/1980 | Sumimoto et al. | 24/16 PB |
| 4,248,462 | A | * | 2/1981 | Choi | 292/322 |
| 4,347,648 | A | | 9/1982 | Dekkers | 24/16 PB |
| 4,688,302 | A | | 8/1987 | Caveney et al. | 24/16 PB |
| 4,754,529 | A | | 7/1988 | Paradis | 24/16 PB |
| 5,183,301 | A | * | 2/1993 | Lundberg, Jr. | 292/318 |
| 5,533,767 | A | * | 7/1996 | Georgopoulos et al. | 292/320 |
| 5,636,412 | A | | 6/1997 | Lodi et al. | 24/16 PB |
| 5,685,048 | A | | 11/1997 | Benoit | 24/16 PB |
| 6,105,210 | A | | 8/2000 | Benoit | 24/16 PB |

FOREIGN PATENT DOCUMENTS

| | | | | |
|---|---|---|---|---|
| GB | 2058194 | | 8/1980 | 24/16 PB |
| GB | 2 163 707 A | * | 3/1986 | 24/16 PB |

OTHER PUBLICATIONS

Brochure, Catamount Manufacturing Incorporated, Restricted Bundle Cable Tie, p. 7.

* cited by examiner

*Primary Examiner*—Robert J. Sandy
*Assistant Examiner*—Ruth C. Rodriguez
(74) *Attorney, Agent, or Firm*—Kriegsman & Kriegsman

(57) ABSTRACT

A tamper-proof tie includes, in one embodiment, a head and an attached strap. The head is shaped to include an elongated interior channel, an articulating locking tang, a strap limiting stop and a door activation surface. The strap includes a first end formed onto the head, a second end and a strap limiting projection disposed between the first and second ends. The portion of the strap from the first end to the strap limiting projection is in the form a flexible filament. The portion of the strap from the strap limiting projection from to the second end includes a top surface, a bottom surface, a ladder structure having a window, an anti-tampering projection formed on the top surface and a door formed on the bottom surface, the door adapted to pivot between an open position and a closed position. In use, the strap is inserted into the interior channel so the tie forms a closed loop. As the strap is inserted into the head, the locking tang engages the window to prevent withdrawal of the strap from the head, the strap limiting projection abuts against the stop to limit the minimum size of the closed loop and the door activation surface urges the door from its open position to its closed position. Together, the strap limiting projection, the anti-tampering projection and the door enclose the interior channel to protect the locking tang from tampering.

12 Claims, 12 Drawing Sheets

TAMPER-PROOF TIE

BACKGROUND OF THE INVENTION

The present invention relates generally to ties and, more particularly, to ties which can be formed into a closed loop.

Ties are well known in the art and are widely used in a variety of different applications.

One tie which is well known and widely used in the art is the cable tie. Cable ties are widely used in the art for bundling together of a plurality of objects, such as a group of wires.

One well known cable tie which is commonly used in commerce comprises a serrated strap which is fitted to an apertured head. In use, the cable tie can be formed into closed loop by inserting the serrated strap through the apertured head. With the serrated strap inserted through the apertured head, an internal pawl, or locking tang, disposed within the apertured head lockably engages the serrations of the strap to prevent the strap from being backed out of the apertured head. In this manner, the engagement of the internal pawl onto the serrated strap secures the cable tie in its closed loop configuration.

Another well known cable tie which is commonly used in commerce comprises an apertured, or ladder-type, strap which is fitted to a buckle-like head. In use, the cable tie can be formed into a closed loop by inserting the ladder-type strap through the buckle-like head. With the ladder strap inserted through the buckle head, a tongue, or internal pawl, disposed within the buckle head lockably engages the apertures of the strap to prevent the strap from being backed out of the head. In this manner, the engagement of the tongue into the apertures of the strap secures the cable tie in its closed loop configuration.

In U.S. Pat. No. 3,766,608 to Fay, which is incorporated herein by reference, there is disclosed a cable tie formed by a locking head and an attached ladder strap. The head contains a longitudinal guide channel for receiving the strap, after encirclement of items to be bundled, and an internal locking tang. The latter is deflected with respect to relatively narrow auxiliary channels on opposite sides of the guide channel. One of the auxiliary channels receives the locking tang during the bundling of the items; the other auxiliary channel contains a stop against which the locking tang becomes abutted in planar engagement by the reverse thrust of the harnessed items.

In U.S. Pat. No. 4,347,648 to Dekkers, which is incorporated herein by reference, there is disclosed a cable tie formed by a locking head and an attached ladder strap. The head contains a locking tang and a guide channel that receives the strap after encirclement of items to be bundled. The tang engages the rungs of the ladder strap for the adjustable retention of the items. The free end of the strap has a light-weight webbed tail that facilitates the insertion of the strap into the head. The strap is advantageously molded of a stretch reorientable material and is subsequently stretched to produce a suitable strengthening and elongation of the webbed tail.

Another tie which is well known and widely used in the art is the fixed-loop tie.

One well known fixed-loop tie which is commonly used in commerce comprises a strap, or fastener, which is fitted to a head. In use, the fixed-loop tie can be formed into a closed loop by inserting the strap into the head. The head is provided with an internal pawl or flange which lockably engages the strap to prevent the strap from being backed out of the head, thereby securing the tie in its closed loop configuration.

Fixed-loop ties differ from traditional cable ties in that fixed-loop ties are constructed in such a manner that the tie can only be formed into a limited range of closed loop sizes. In particular, the strap of a fixed-loop tie is commonly provided with an enlarged stop which limits the degree of advancement which the strap can be inserted into the head, thereby creating a minimum size closed loop into which the tie can be formed during use.

Fixed-loop ties are commonly used in a plurality of different applications.

As an example, fixed-loop ties are commonly used in the art to couple together two or more objects, fixed-loop ties which are utilized in this manner being commonly identified as merchandise pairing ties in the art. As can be appreciated, merchandise pairing ties are commonly used in the art to couple together a pair of shoes. In this capacity, merchandise pairing ties have been found to be not only a very useful device in displaying the pair of shoes for sale but also an effective device for preventing the theft of a single shoe, which is a common transgression.

To use a fixed-loop tie of the type described above to pair together a pair of shoes, the tail end of the strap is inserted through an eyelet or under the shoelace of each shoe. The tail is then inserted through a guide channel formed in the head so that the tie forms a closed loop. As the strap is further drawn forward through the guide channel of the head, the closed loop decreases in size. However, it should be noted that, increased insertion of the strap through the head will eventually cause the stop formed on the strap to abut against the head, thereby preventing further insertion of the strap into the head and limiting the size of the closed loop formed by the tie. As can be appreciated, because such a merchandise pairing tie has a substantially large minimum closed loop size, the shoes are ensured a substantial degree of separation which enables a prospective buyer the opportunity to comfortably try on and walk around in the shoes, which is highly desirable.

In U.S. Pat. No. 6,105,210 to J. C. Benoit, which issued on Aug. 22, 2000 and which is incorporated herein by reference, there is disclosed a merchandise pairing tie for use in pairing together two objects. The tie comprises a head having an elongated channel extending therethrough, a locking tang within the head, and a strap having a length of approximately 63.3 cm. The strap comprises a first end integrally formed onto the head and a second end. A projection is formed on the strap between the first end and the second end. The portion of the strap from the projection to the first end is in the form of an elongated, flexible filament having a length of approximately 59.5 cm. The elongated filament is narrow in thickness, narrow in width and has a generally uniform, rectangularly-shaped cross-section. In one embodiment, the portion of the strap from the projection to the second end is formed in a ladder structure having a plurality of rungs. The rungs of the strap are sequentially engaged by the locking tang when the strap is inserted into and through the elongated channel to form a closed loop. As the strap is further inserted through the elongated channel, the size of the closed loop is decreased. The projection serves as a stop to limit the minimum size of the closed loop which can be formed when the strap is inserted into the head.

As another example, fixed-loop ties are also commonly used in the art to secure the cover, or lid, of a box, or other similar container, in a closed position. In particular, fixed-loop ties of this type are often used to secure the cover of a pharmaceutical tote box or a food supply container in a closed position during shipping. As such, the closed-loop tie acts as security device for preventing the theft of the items held within the container.

As another example, fixed-loop ties are also commonly used in the art to secure a ticket, or tag, onto an article of clothing. In particular, fixed-loop ties of this type are often used to secure a ski ticket, or pass, onto the jacket of a consumer. As such, the fixed-loop tie acts as a security device for preventing an unscrupulous consumer from removing the ski ticket from his/her jacket in order to enable another person to share in the use of the same ticket.

Although well known and widely used in commerce, cable ties and fixed-loop ties of the type described above suffer from a notable drawback. Specifically, it has been found that ties of the type described above are susceptible to tampering. In fact, it has been found that, on occasion, unscrupulous consumers have been able to tamper with the locking tang in the head of the tie so as to disengage the locking tang from the strap, thereby enabling the consumer to back the strap out from the head and open the closed loop formed by the tie. As can be appreciated, when such a tie is used in a security application, such as to secure the lid of a pharmaceutical tote box in a closed position during shipping, the ability of an unscrupulous consumer to tamper with the tie can result in theft, which is highly undesirable.

SUMMARY OF THE INVENTION

It is an object of the present invention to provide a new and improved tie.

It is another object of the present invention to provide a tie of the type comprising a locking head and an attached strap, wherein the tie can be formed into a closed loop by inserting the strap into the locking head.

It is yet another object of the present invention to provide a tie of the type described above wherein the locking head includes a pawl which, with the strap inserted into the locking head, engages the strap to secure the tie in its closed loop configuration.

It is still another object of the present invention to provide a tie as described above which is constructed to prevent tampering of the pawl when the tie is formed in its closed loop configuration.

It is another object of the present invention to provide a tie as described above which can be constructed from a single molded piece.

It is yet another object of the present invention to provide a tie as described above which is inexpensive to manufacture and easy to use.

Accordingly, in one embodiment of the present invention, there is provided a tie comprising a head which is shaped to include an elongated interior channel therethrough, said head comprising a locking tang which is disposed to project into the elongated interior channel, and a strap having a first end and a second end, the first end being integrally formed onto said head, said strap being sized and shaped to be inserted into the elongated interior channel so said tie forms a closed loop, wherein increased insertion of said strap into the elongated interior channel decreases the size of the closed loop, said strap including a strap limiting projection formed thereon between the first end and the second end, said strap limiting projection limiting the minimum size of the closed loop which can be formed, the portion of said strap from the strap limiting projection to the second end including a top surface and a bottom surface, the portion of said strap from said strap limiting projection to the second end being adapted to be engaged by said locking tang when said tie is formed into a closed loop, wherein an anti-tampering projection is formed on the top surface of the portion of said strap from said strap limiting projection to the second end.

In another embodiment of the present invention, there is provided a tie comprising a head which is shaped to include an elongated interior channel therethrough, said head comprising a locking tang which is disposed to project into the elongated interior channel, and a strap having a first end and a second end, the first end being integrally formed onto said head, said strap being sized and shaped to be inserted into the elongated interior channel so said tie forms a closed loop, wherein increased insertion of said strap into the elongated interior channel decreases the size of the closed loop, said strap including a strap limiting projection formed thereon between the first end and the second end, said strap limiting projection limiting the minimum size of the closed loop which can be formed, the portion of said strap from said strap limiting projection to the second end including a top surface and a bottom surface, the portion of said strap from said strap limiting projection to the second end being adapted to be engaged by said locking tang when said tie is formed into a closed loop, wherein an anti-tampering projection is formed on the top surface of the portion of said strap from said strap limiting projection to the second end, wherein, with the portion of said strap from said strap limiting projection to the second end engaged by said locking tang, said strap is sized and shaped such that the second end of said strap is disposed entirely within said head.

In another embodiment of the present invention, there is provided a tie comprising a head which is shaped to include an elongated interior channel therethrough, said head comprising a locking tang which is disposed to project into the elongated interior channel, and a strap having a first end and a second end, the first end being integrally formed onto said head, said strap being sized and shaped to be inserted into the elongated interior channel so said tie forms a closed loop, wherein increased insertion of said strap into the elongated interior channel decreases the size of the closed loop, said strap including a strap limiting projection formed thereon between the first end and the second end, said strap limiting projection limiting the minimum size of the closed loop which can be formed, the portion of said strap from said strap limiting projection to the second end including a top surface and a bottom surface, the portion of said strap from said strap limiting projection to the second end being adapted to be engaged by said locking tang when said tie is formed into a closed loop, wherein an anti-tampering projection is formed on the top surface of the portion of said strap from said strap limiting projection to the second end, wherein a door is formed on the bottom surface of the portion of said strap from the strap limiting projection to the second end, said door being adapted to pivot between an open position and a closed position.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the present invention and, together with the description, serve to explain the principles of the invention. In the drawings, wherein like reference numerals represent like parts.

DETAILED DESCRIPTION OF A PREFERRED EMBODIMENT

Figure 1:
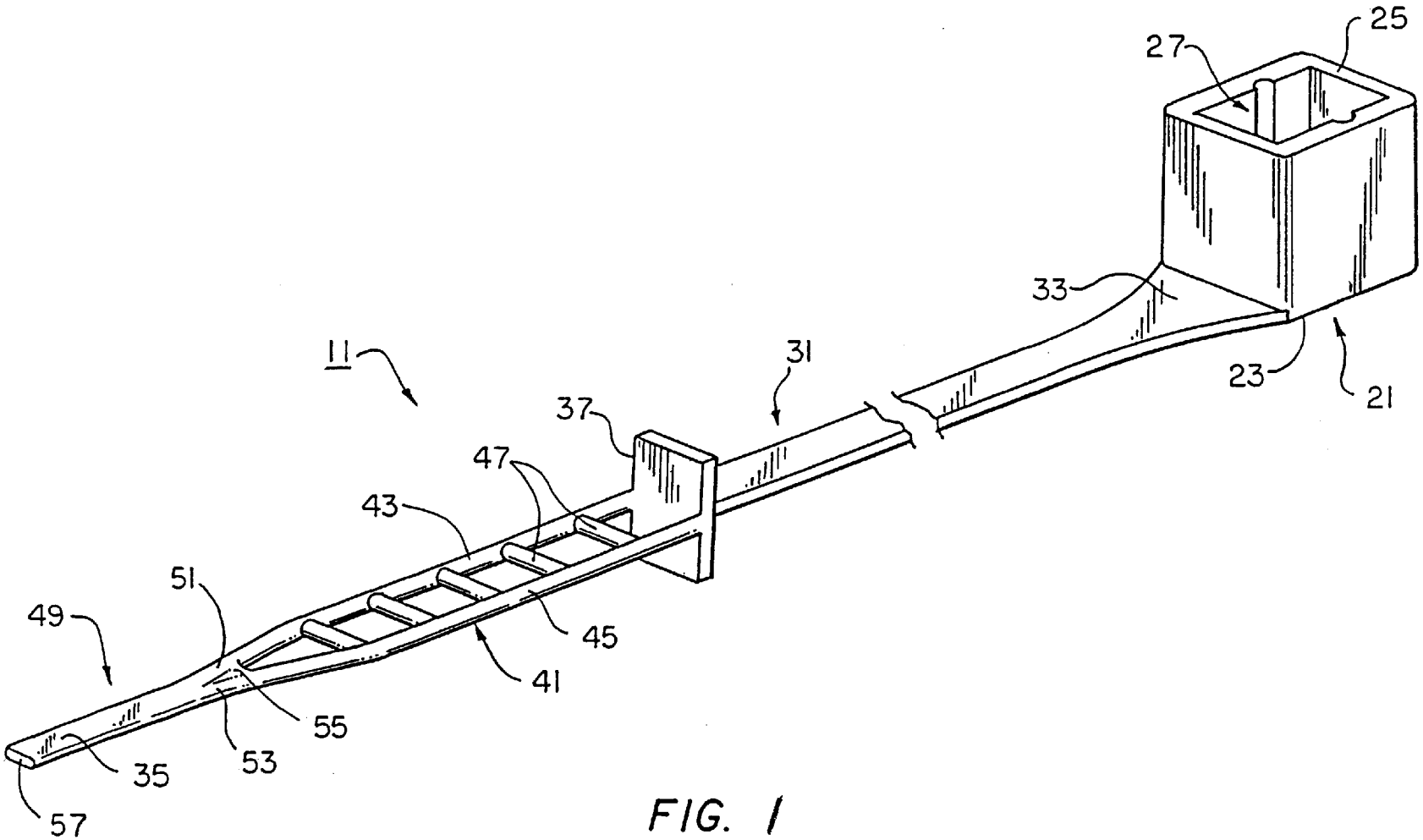
FIG. 1 PRIOR ART
FIG. 1 is a fragmentary, top perspective view of a prior art tie for pairing together two objects.
Figure 2:
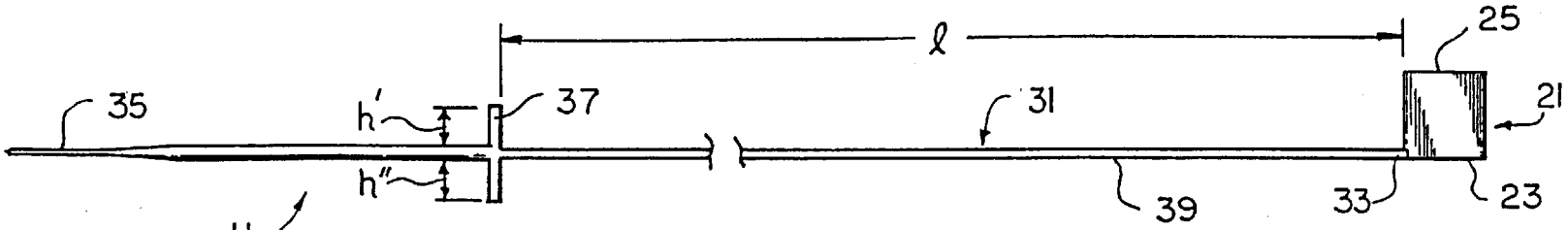
FIG. 2 PRIOR ART
FIG. 2 is a fragmentary, right side view of the prior art tie shown in FIG. 1.
Figure 3:
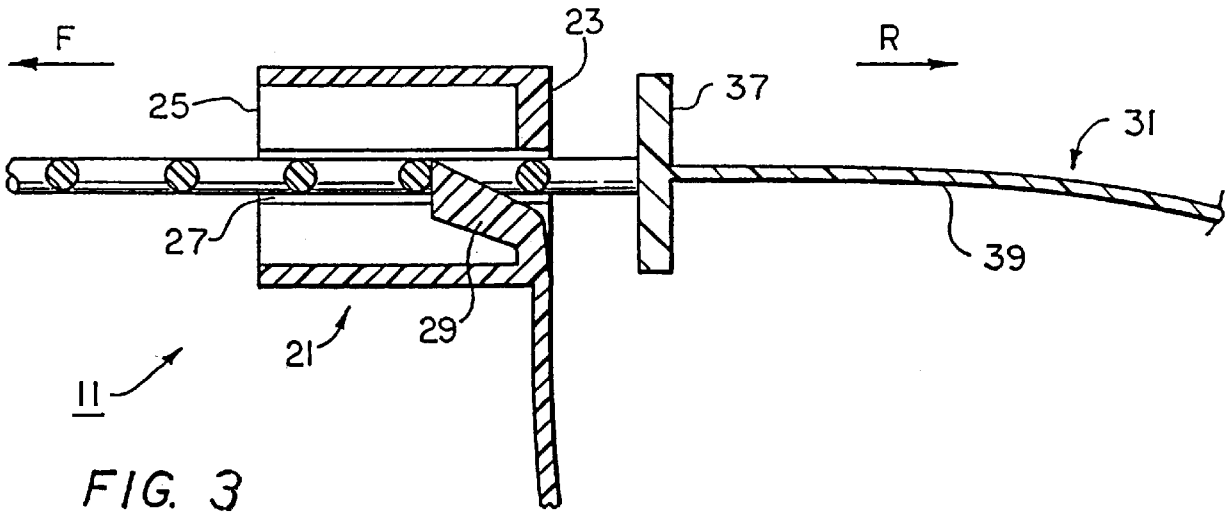
FIG. 3 PRIOR ART
FIG. 3 is a fragmentary, side section view of the prior art tie shown in FIG. 1, the tie being shown with the strap inserted through the head.
Figure 4:
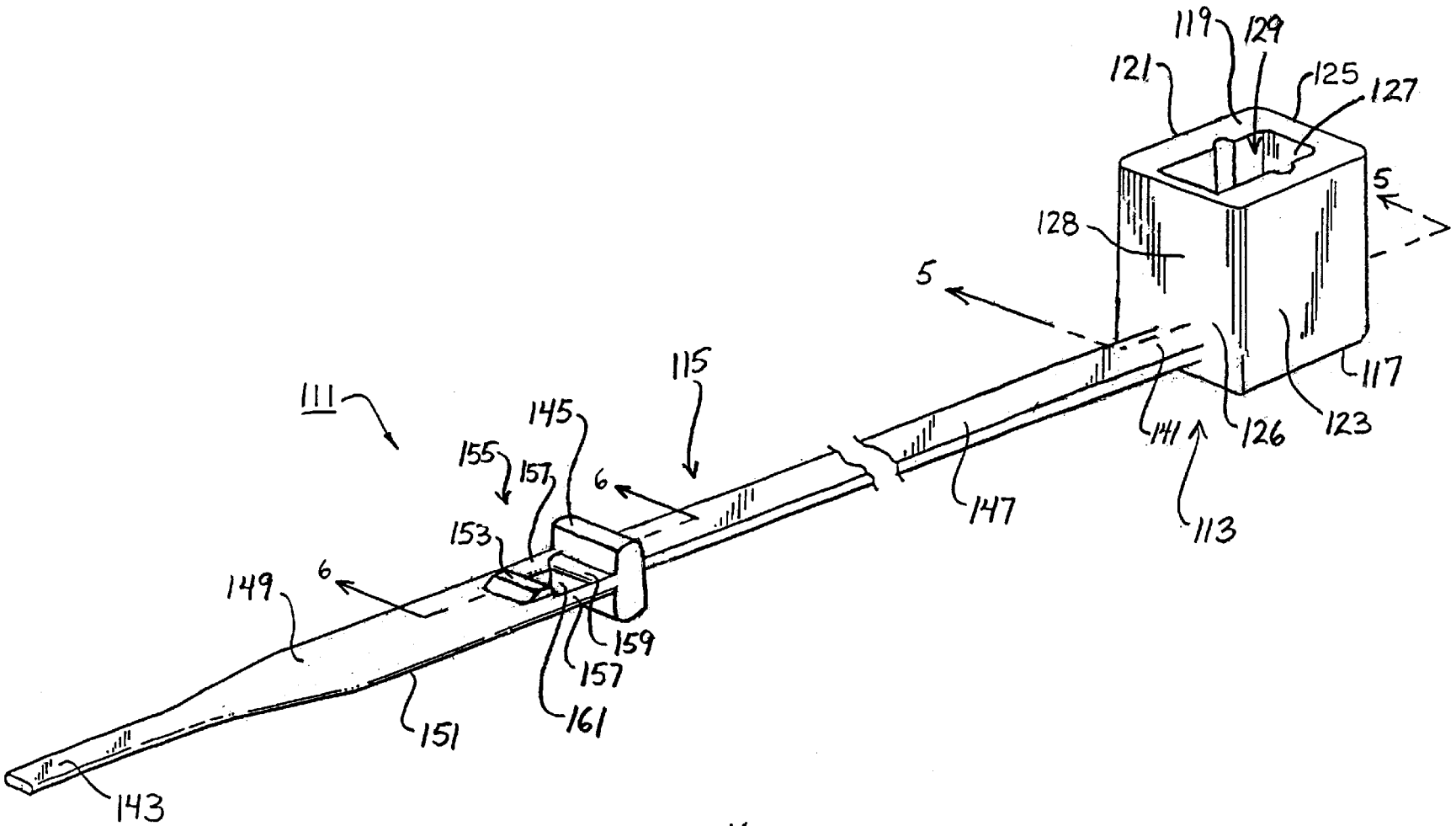
FIG. 4 is a fragmentary, top perspective view of an embodiment of a tie constructed according to the teachings of the present invention.

Referring now to FIGS. 1–3, there is shown a prior art tie constructed according to the teachings of the present invention for pairing together two objects, the tie being represented generally by reference numeral 11. Prior art tie 11 is of the type disclosed in U.S. Pat. No. 6,105,210 to J. C. Benoit, which is incorporated herein by reference.

Prior art tie 11 includes a head 21 and an attached strap 31. Preferably, tie 11 is integrally formed using conventional molding techniques.

Head 21 is generally rectangular in shape and includes a bottom wall 23, a top wall 25, and an elongated channel 27 which extends through head 21 from bottom wall 23 to top wall 25. Head 21 further includes a locking tang 29 which may be either of the stationary type or the deflectable type.

Strap 31 comprises a first end 33, a second end 35 and an enlarged rectangular projection 37 which is formed on strap 31 at a location between first end 33 and second end 35. First end 33 is integrally formed onto head 21 to make tie 11 a unitary device. Projection 37 serves as a stop when tie 11 is used to pair together two objects, as will be described in detail below. Projection 37 also serves to divide strap 31 into two portions.

The portion of strap 31 from projection 37 to first end 33 is in the form of an elongated, flexible filament 39. Elongated, flexible filament 39 is narrow in thickness, narrow in width, and has a generally uniform, rectangularly-shaped cross-section.

The portion of strap 31 from projection 37 to second end 35 comprises a ladder structure 41. Ladder structure 41 comprises a pair of side rails 43 and 45 and a plurality of rungs 47. Ladder structure 41 terminates into a elongated webbed tail 49 which is formed at second end 35. Tail 49 is formed by extensions 51 and 53 of side rails 43 and 45, respectively. Webbing 55 occupies the interval between extension side rails 51 and 53. Tail 49 tapers into a narrow tip 57 approximately 3 mm in width.

As shown in FIG. 2, projection 37 protrudes upward above rungs 47 a distance "h'" of approximately 1 mm. Similarly, projection 37 protrudes downward beneath rungs 47 a distance "h"" of approximately 1 mm.

Upon completion of the molding process for tie 11, filament 39 can be stretched using conventional stretching techniques so that projection 37 is a distance "1" of approximately 59.5 cm from head 21, strap 31 having a total length of approximately 63.3 cm after the stretching process. Strap 31 is preferably constructed of a molecular reorientable type material, such as nylon, polypropylene, polyester, urethane, or the like. This material, upon stretching, not only reduces the volume per unit length of the strap but also provides enhanced physical properties, such as an increase in tensile and shear strength.

In use, tie 11 can be used to pair together two shoes, or other similar objects such as sneakers or sandals, in the following manner. First, tail 49 is threaded through an eyelet in each shoe. Tail 49 is then inserted into channel 27 of head 21 to form a closed loop. Tail 49 is advanced through bottom wall 23 of head 21 and out through top wall 25 in a forward direction, the forward direction being represented by arrow F in FIG. 3. Drawing strap 31 forward through head 21 decreases the size of the closed loop. Locking tang 29 is designed so as to permit strap 31 to advance forward through head 21. Locking tang 29 is also designed to engage rungs 47 when strap 31 is thrust in the reverse direction, the reverse direction being shown by arrow R in FIG. 3. Therefore, strap 31 can be advanced forward through head 21 to decrease the size of the closed loop, but strap 31 can not be thrust in the reverse direction to increase the size of the closed loop or to open the closed loop. As a result, once strap 31 is advanced through head 21 to secure the pair of shoes together, the shoes remain paired together until cable tie 11 is severed.

Strap 31 is capable of advancement through head 21 until projection 37 hits up against bottom wall 23 of head 21. As can be appreciated, projection 37 limits how far strap 31 can be advanced forward through head 21, thereby limiting the minimum size of the closed loop. Due to the location of projection 37 on strap 31, tie 11 can be used to pair together two objects but, at the same time, can enable the two objects to be separated approximately 29.5 cm apart from one another, the approximate distance required for one to comfortably try on and walk around in a pair of shoes at the same time, which is desirable.

Although well known and widely used in commerce, tie 11 suffers from a notable drawback. Specifically, it has been found that locking tang 29 is susceptible to tampering. As can be appreciated, if projection 37 can be spaced slightly away from bottom wall 23, an unscrupulous consumer is capable of tampering with locking tang 29 through either end of elongated channel 27. Because locking tang 29 is susceptible to tampering, tie 11 can be opened after formed into a closed loop, thereby rendering tie 11 less desirable for use in security applications.

Accordingly, referring now to FIGS. 4–7, there is provided an embodiment of a tie constructed according to the teachings of the present invention, the tie being identified generally be reference numeral 111. As will be described further in detail below, the particular construction of tie 111 renders it less susceptible to tampering, which is highly desirable.

Preferably, tie 111 is of the type which can be used to securely fasten a ski tag onto an article of clothing, such as a ski jacket. However, tie 111 is not limited to ski tag fastening applications. Rather, it is to be understood that tie 111 could be used in alternative applications, such as in merchandise pairing applications, without departing from the spirit of the present invention.

Tie 111 comprises a head 113 and an attached strap 115. Preferably, tie 111 is formed as a single piece using conventional molding techniques.

Head 113 is generally rectangular in shape and comprises a bottom wall 117, a top wall 119, a first sidewall 121, a second sidewall 123, an outer end wall 125 and an inner end wall 126. First sidewall 121, second sidewall 123, outer end wall 125 and inner end wall 126 together define an inner surface 127 for head 113, an outer surface 128 for head 113 and an elongated interior channel 129 which extends longitudinally through head 113 from bottom wall 117 to top wall 119, elongated interior channel 129 having a strap entry end 131 formed in bottom wall 117 and a strap exit end 133 formed in top wall 119.

It should be noted that the lateral cross-sectional area of interior channel 129 is considerably smaller than the lateral cross-sectional area of channel 27 of prior art tie 11. As can be appreciated, the reduced lateral cross-sectional area of interior channel 129 renders tie 111 less susceptible to tampering, which is highly desirable.

Figure 5:
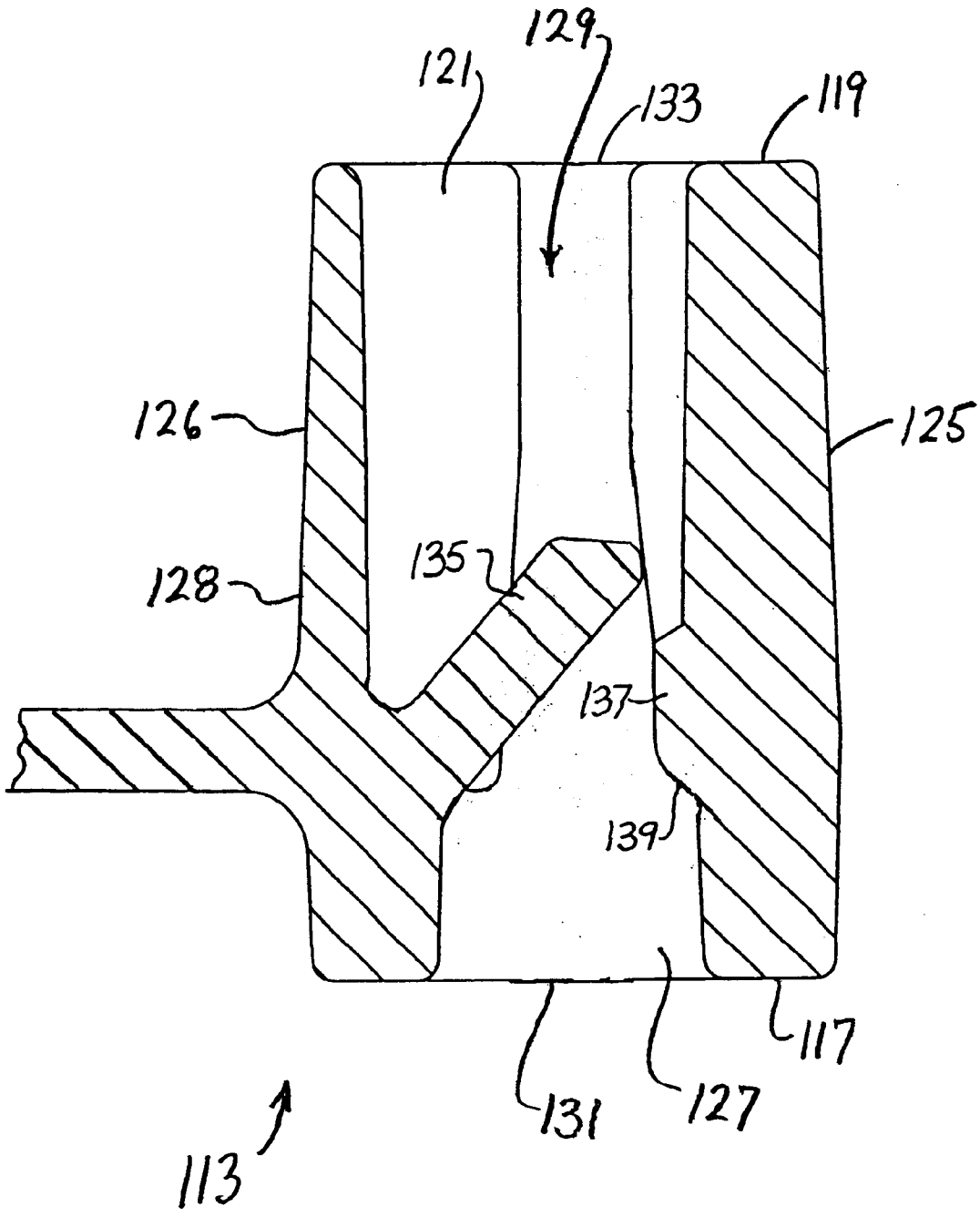
FIG. 5 is an enlarged, fragmentary, right side section view of the tie shown in FIG. 4, taken along lines 5—5.

Referring now to FIG. 5, head 113 also comprises a locking tang 135 which is integrally formed onto inner surface 127 of inner end wall 126 and which projects into interior channel 129. Preferably, locking tang 135 is of the deflectable type which is capable of articulation. However, it is to be understood that locking tang 135 could alternatively be of the stationary type which is incapable of articulation without departing from the spirit of the present invention.

Head 113 further comprises a strap limiting stop 137 which is integrally formed onto inner surface 127 of outer end wall 125 and which projects into interior channel 129. Stop 137 is fixedly formed onto outer end wall 125 and includes a flat abutment surface 139.

It should be noted that locking tang 135 and strap limiting stop 137 are both spaced adequately away from bottom wall 117 and top wall 119, as shown in FIG. 5. To the contrary, locking tang 29 in prior tie 11 is formed directly at bottom wall 23, as shown in FIG. 3. As will be described further in detail below, spacing locking tang 135 and strap limiting stop 137 adequately away from bottom wall 117 renders tie 111 less susceptible to tampering, which is highly desirable.

Strap 115 comprises a first end 141 and a second end 143. First end 141 is integrally formed on head 113 so as to render tie 111 a unitary device.

Strap 115 also comprises a strap limiting projection 145 which is formed between first end 141 and second end 143. Strap limiting projection 145 extends out from both sides of strap 115 and is generally rectangular in longitudinal and lateral cross-section, strap limiting projection 145 comprising an upper abutment surface 146-1 and a lower abutment surface 146-2. As will be described further in detail below, projection 145 serves to limit the degree to which strap 115 can be advanced through interior channel 129 of head 113.

The portion of strap 115 from projection 145 to first end 141 is in the form of an elongated flexible filament 147. Filament 147 preferably includes a generally uniform, rectangularly-shaped lateral cross-section. However, it is to be understood that filament 147 could be constructed in alternative sizes and shapes without departing from the spirit of the present invention.

The portion of strap 115 from projection 145 to second end 143 comprises a substantially flat top surface 149 and a substantially flat bottom surface 151. In addition, the portion of strap 115 from projection 145 to second end 143 tapers in slightly at second end 143 to facilitate the insertion of strap 115 into head 113 during use.

Figure 6:
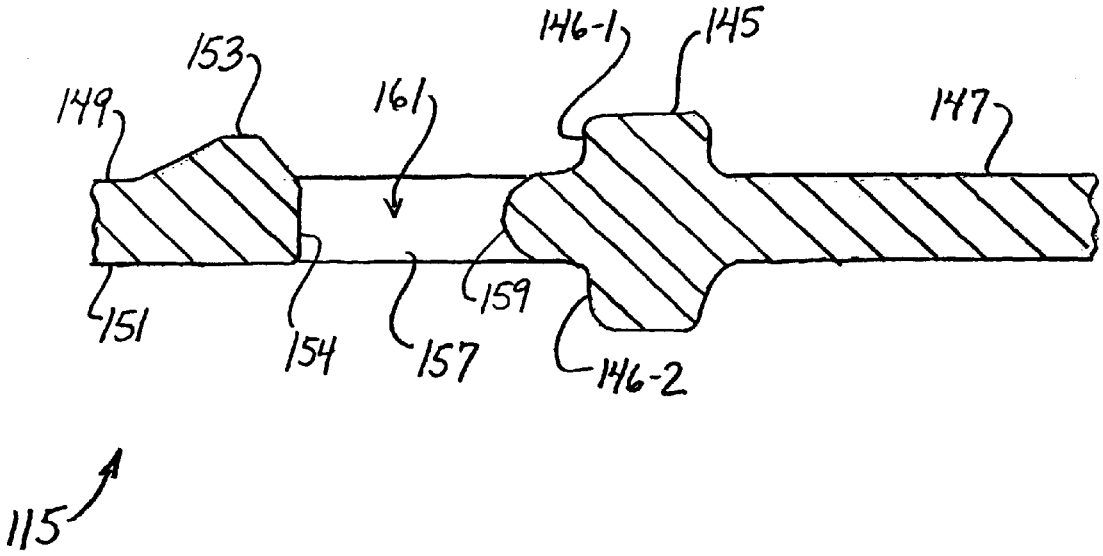
FIG. 6 is an enlarged, fragmentary, right side section view of the tie shown in FIG. 4, taken along lines 6—6.
Figure 7A:
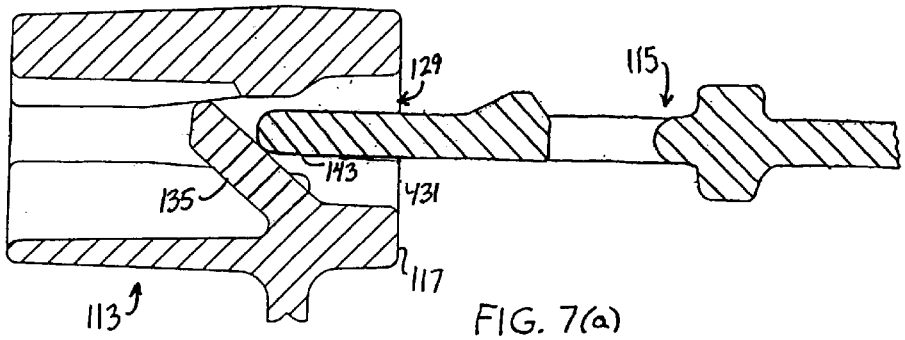
FIGS. 7(*a*)–7(*d*) represent a series of fragmentary, right side section views of the tie shown in FIG. 4 as the strap is inserted through the head.
Figure 7B:
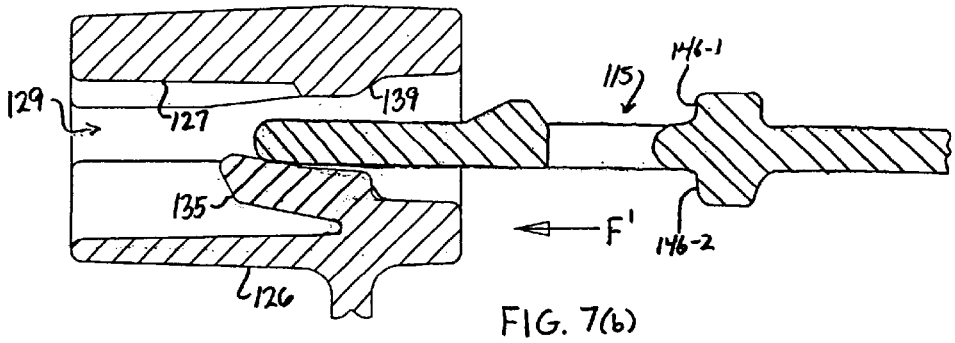
Figure 7C:
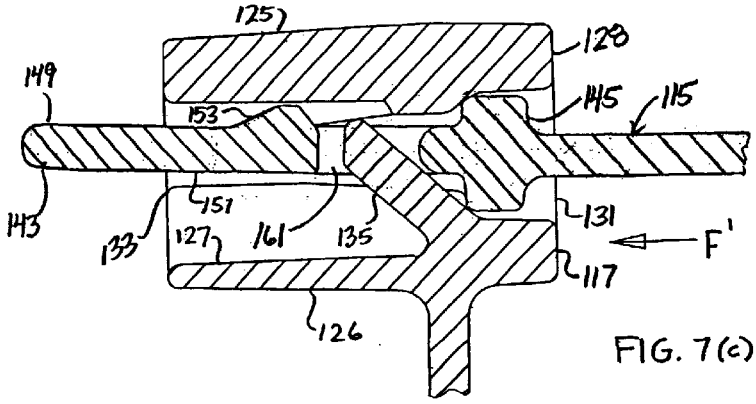
Figure 7D:
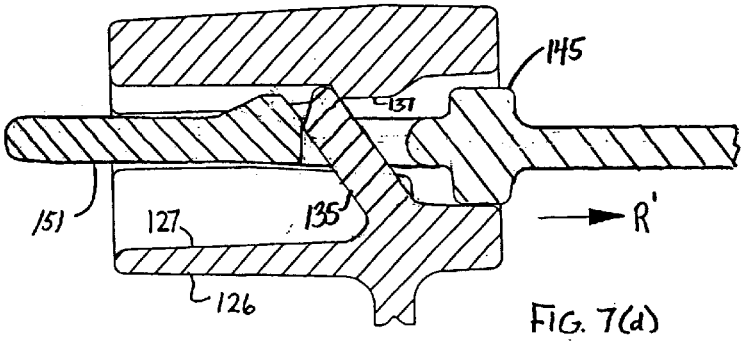

An anti-tampering projection 153 is formed on top surface 149 of strap 115 between projection 145 and second end 143, anti-tampering projection 153 being preferably trapezoidal in longitudinal cross-section. Together, anti-tampering projection 153 and strap 115 form a substantially straight locking tang engagement surface 154, as shown in FIG. 6. In use, anti-tampering projection 153 serves to facilitate enclosing exit end 133, thereby rendering tie 111 less susceptible to tampering, as will be described further in detail below.

The portion of strap 115 from projection 145 to second end 143 further comprises a ladder structure 155. Specifically, ladder structure 155 comprises a pair of side rails 157 and a rung 159 which extends laterally between side rails 157. Together, engagement surface 154, side rails 157 and rung 159 define a rectangular opening, or window, 161.

It should be noted that strap 115 it is not limited to the inclusion of opening 161. Rather, opening 161 could be replaced with a thin wall, or membrane, which lies entirely between top surface 149 and bottom surface 151 without departing from the spirit of the present invention.

It should also be noted that engagement surface 154 is not limited to being a flat surface which is formed onto anti-tampering projection 153. Instead, it is to be understood that, engagement surface 154 could be formed onto an additional rung which is disposed between anti-tampering projection 153 and window 161 without departing from the spirit of the present invention.

It should also be noted that ladder structure 155 is not limited to single window 161. Although strap 115 of tie 111 preferably includes a single window 161, it is to be understood that additional windows could be configured into ladder structure 155 without departing from the spirit of the present invention.

In use, tie 111 can be used to securely fasten a ski tag onto an article of clothing in the following manner. First, second end 143 of strap 115 is either threaded through an opening formed in the ski tag or, in the alternative, an adhesive backed ski tag is wrapped around filament 147. Second end 143 of strap 115 is then inserted through an opening formed in the article of clothing, such as through an opening formed in a zipper on the article of clothing.

Referring now to FIG. 7(*a*), second end 143 of strap 115 is then inserted in through strap entry end 131 of elongated interior channel 129 so that tie 111 forms a closed loop. Referring now to FIG. 7(*b*), as strap 115 is advanced in the forward direction through interior channel 129, as represented by arrow F', locking tang 135 pivots down towards inner end wall 126 to enable strap 115 to pass through head 113. Referring now to FIG. 7(*c*), continued advancement of strap 115 in the forward direction eventually causes locking tang 135 to pivot back up and protrude through window 161, thereby locking tie 111 in its closed loop configuration.

It should be noted that, with locking tang 135 protruding through window 161, second end 143 of strap 115 protrudes out through strap exit end 133 of elongated interior channel 129.

It should also be noted that, with locking tang 135 protruding through window 161, projection 145 abuts against strap limiting stop 137 and locking tang 135, thereby limiting further forward advancement of strap 115 through head 113. Specifically, upper abutment surface 146-1 of projection 145 contacts abutment surface 139 of strop 137 and lower abutment surface 146-2 contacts locking tang 135 at its conjunction with inner surface 127 of inner end wall 126. As can be appreciated, projection 145 not only limits the forward advancement of strap 115 through head 113 but also serves as a wall for enclosing strap entry end 131 of head 113, thereby rendering tie 111 less susceptible to tampering, which is highly desirable. Because projection 145 abuts against abutment surface 139 and locking tang 135 at a distance spaced adequately in from strap entry end 131, locking tang 135 is less susceptible to tampering than if projection 145 were to abut against outer surface 128 of bottom wall 117.

It should further be noted that, with locking tang 135 protruding through window 161, anti-tampering projection 153 extends up to inner surface 127 of outer end wall 125. As such, anti-tampering projection 153 forms a barrier, or enclosure, between top surface 149 of strap 115 and inner surface 127 of outer end wall 125, thereby rendering locking tang 135 less susceptible to tampering, which is highly desirable.

As noted above, with tie 111 formed into its closed loop configuration, second end 143 of strap 115 protrudes out through strap exit end 133 of elongated interior channel 129. As can be appreciated, it has been found that the protrusion of second end 143 out through head 113 can be undesirable in particular applications. Specifically, in ski tag applications, it has been found that the protrusion of second end 143 out through head 113 can often disturb or injure the person wearing the ski tag.

Figure 8:
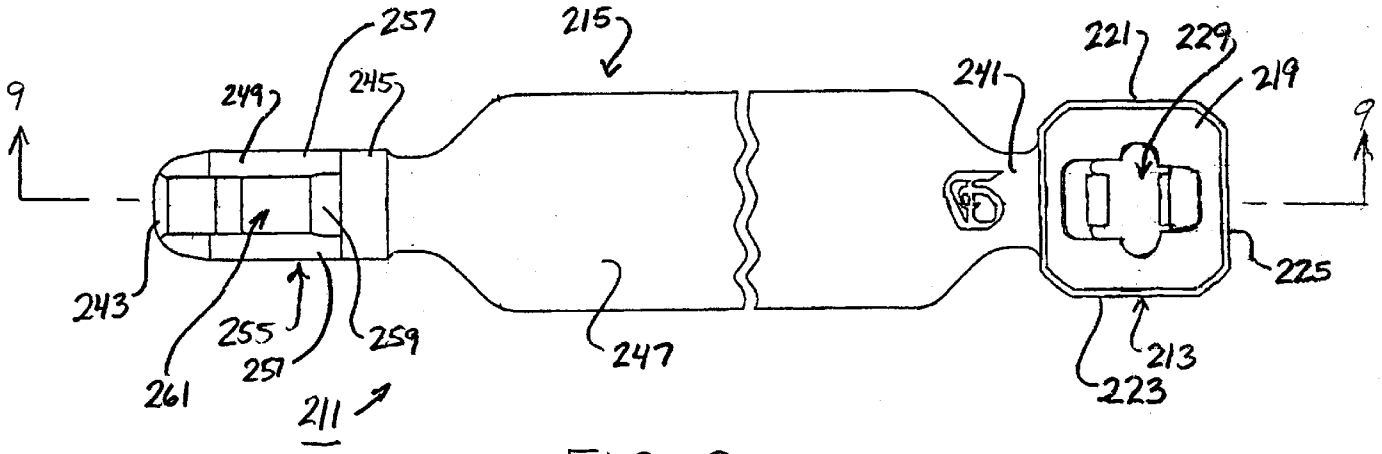
FIG. 8 is a fragmentary, top plan view of another embodiment of a tie constructed according to the teachings of the present invention.
Figure 9:
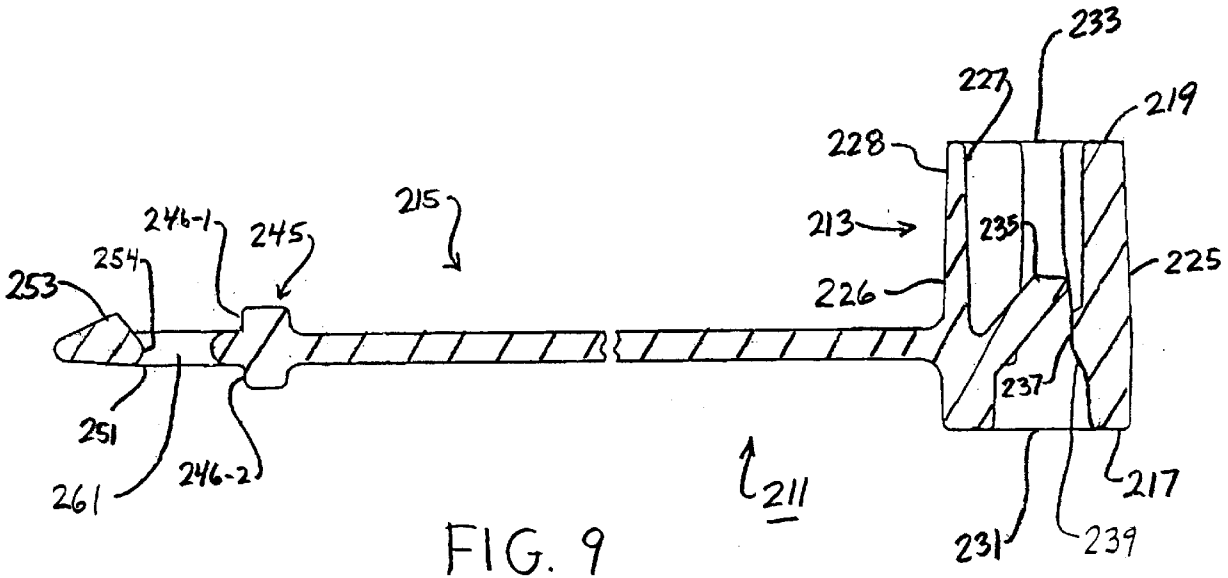
FIG. 9 is a fragmentary, right side section view of the tie shown in FIG. 8, taken along lines 9—9.
Figure 10:
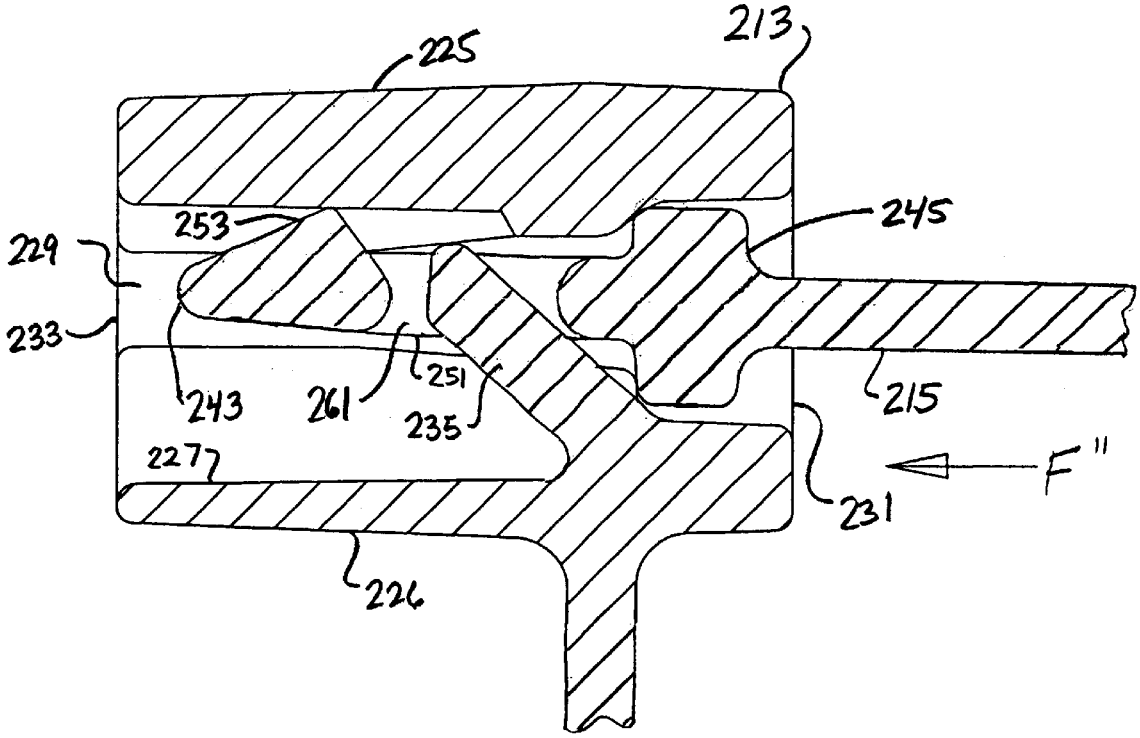
FIG. 10 is an enlarged, fragmentary, right side section view of the tie shown in FIG. 8, the tie being shown with the tail inserted into the head.
Figure 11:
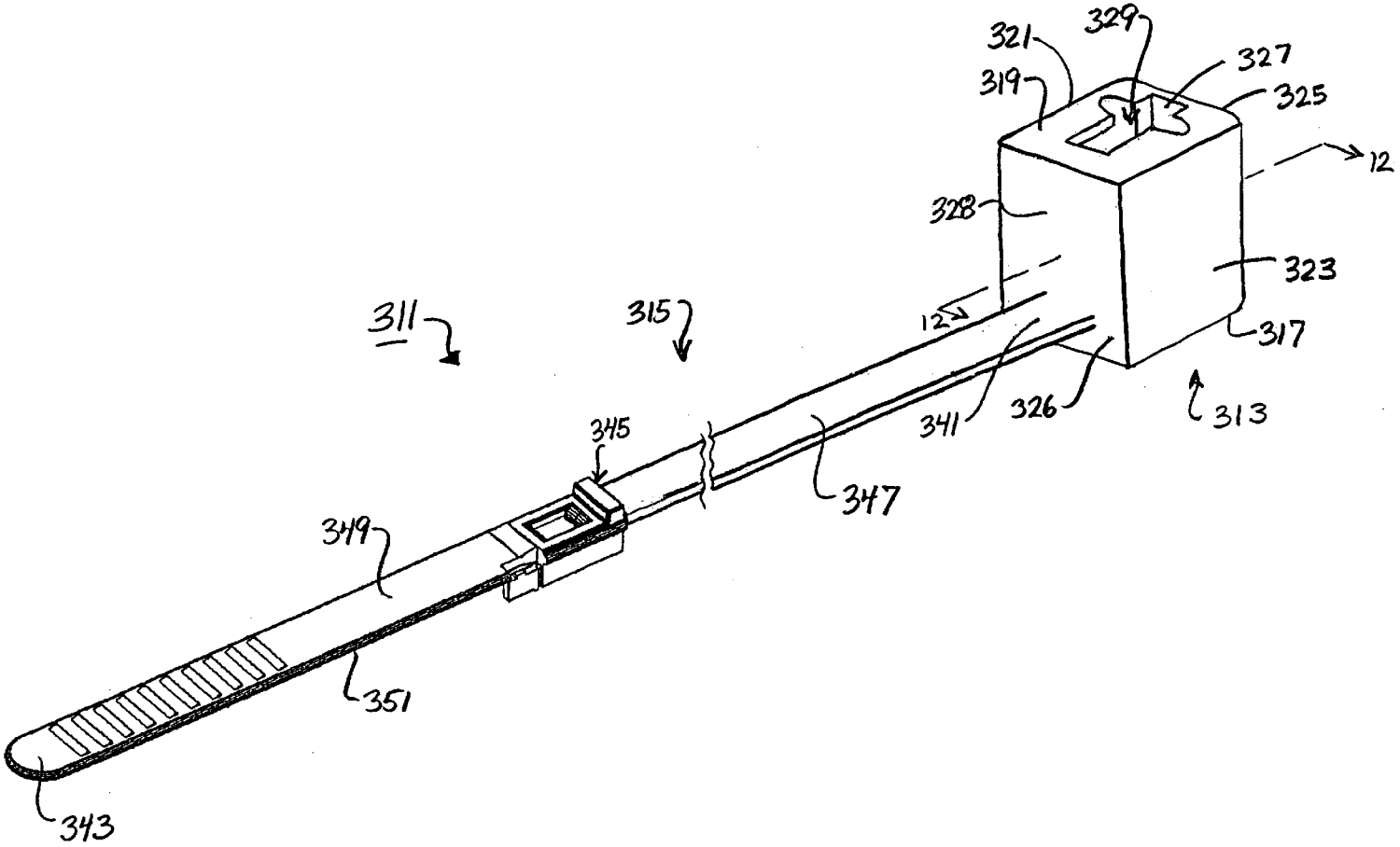
FIG. 11 is a fragmentary, top perspective view of another embodiment of a tie constructed according to the teachings of the present invention.

Accordingly, referring now to FIGS. 8–10, there is provided another embodiment of a tie constructed according to the teachings of the present invention, the tie being identified generally by reference numeral 211. As will be described further in detail below, tie 211 is designed such that, with tie 211 formed into its closed loop configuration, no free end is exposed which can irritate or injure the wearer. Preferably, tie 211 is of the type which can be used to securely fasten a ski tag onto an article of clothing, such as a ski jacket. However, tie 211 is not limited to ski tag fastening applications. Rather, it is to be understood that tie 211 could be used in alternative applications, such as in merchandise pairing applications, without departing from the spirit of the present.

Tie 211 is similar in construction with tie 111. Specifically, tie 211 comprises a head 213 and an attached strap 215. Preferably, tie 211 is formed as a single piece using conventional molding techniques.

Head 213 is similar to head 113 in that head 213 is generally rectangular in shape and comprises a bottom wall 217, a top wall 219, a first sidewall 221, a second sidewall 223, an outer end wall 225 and an inner end wall 226. First sidewall 221, second sidewall 223, outer end wall 225 and inner end wall 226 together define an inner surface 227 for head 213, an outer surface 228 for head 213 and an elongated interior channel 229 which extends longitudinally through head 213 from bottom wall 217 to top wall 219, elongated interior channel 229 having a strap entry end 231 formed in bottom wall 217 and a strap exit end 233 formed in top wall 219.

Referring now to FIG. 9, head 213 also comprises a locking tang 235 which is integrally formed onto inner surface 227 of inner end wall 226 and which projects into interior channel 229. Preferably, locking tang 235 is of the deflectable type which is capable of articulation. However, it is to be understood that locking tang 235 could alternatively be of the stationary type which is incapable of articulation without departing from the spirit of the present invention.

Head 213 further comprises a strap limiting stop 237 which is integrally formed onto inner surface 227 of outer end wall 225 and which projects into interior channel 229. Stop 237 is fixedly formed onto outer end wall 225 and includes a flat abutment surface 239.

It should be noted that locking tang 235 and strap limiting stop 237 are both spaced adequately away from bottom wall 217 and top wall 219 to render tie 211 less susceptible to tampering, which is highly desirable.

Strap 215 comprises a first end 241 and a second end 243. First end 241 is integrally formed on head 213 so as to render tie 211 a unitary device.

Strap 215 also comprises a strap limiting projection 245 which is formed between first end 241 and second end 243. Strap limiting projection 245 extends out from both sides of strap 215 and is generally rectangular in longitudinal and lateral cross-section, strap limiting projection 245 comprising an upper abutment surface 246-1 and a lower abutment surface 246-2. As can be appreciated, projection 245 serves to limit the degree to which strap 215 can be advanced through interior channel 229 of head 213.

The portion of strap 215 from projection 245 to first end 241 is in the form of a widened band 247. As can be appreciated, due to its widened construction, band 247 is considerably stronger than filament 147 of tie 111. However, it is to be understood that widened band 247 could be constructed in alternative sizes and shapes without departing from the spirit of the present invention.

The portion of strap 215 from projection 245 to second end 243 comprises a substantially flat top surface 249 and a substantially flat bottom surface 251.

An anti-tampering projection 253 is formed on top surface 249 of strap 215 at second end 243, anti-tampering projection 253 being preferably triangular in longitudinal cross-section. Together, anti-tampering projection 253 and strap 215 form a curved locking tang engagement surface 254, as shown in FIG. 9. In use, anti-tampering projection 253 serves to facilitate enclosing exit end 233, thereby rendering tie 211 less susceptible to tampering.

The portion of strap 215 from projection 245 to second end 243 further comprises a ladder structure 255. Specifically, ladder structure 255 comprises a pair of side rails 257 and a rung 259 which extends laterally between side rails 257. Together, engagement surface 254, side rails 257 and rung 259 define a rectangular opening, or window, 261.

It should be noted that strap 215 it is not limited to the inclusion of opening 261. Rather, opening 261 could be replaced with a thin wall, or membrane, which lies entirely between top surface 249 and bottom surface 251 without departing from the spirit of the present invention.

In use, tie 211 functions similarly to tie 111. Specifically, referring now to FIG. 10, second end 243 of strap 215 is inserted in through strap entry end 231 of elongated interior channel 229 so that tie 211 forms a closed loop. As strap 215 is advanced in the forward direction through interior channel 229, as represented by arrow F", locking tang 235 pivots down towards inner end wall 226 to enable strap 215 to pass through head 213. Continued advancement of strap 215 in the forward direction eventually causes locking tang 235 to pivot back up and protrude through window 261, thereby locking tie 211 in its closed loop configuration.

The principal distinction between tie 211 and tie 111 lies in the fact that, with locking tang 235 protruding through window 261, second end 243 of strap 215 remains within elongated interior channel 129 of head 213. As such, second end 243 is precluded from irritating or injuring the person wearing the ski tag, which is highly desirable.

It should also be noted that, with locking tang 235 protruding through window 261, projection 245 abuts against strap limiting stop 237 and locking tang 235, thereby limiting further forward advancement of strap 215 through head 213. As can be appreciated, projection 245 not only limits the forward advancement of strap 215 through head 213 but also serves as a wall for enclosing strap entry end 231 of head 213, thereby rendering tie 211 less susceptible to tampering, which is highly desirable. Because projection 245 abuts against abutment surface 239 and locking tang 235 at a distance spaced adequately in from strap entry end 231, locking tang 235 is less susceptible to tampering than if projection 245 were to abut against outer surface 228 of bottom wall 217.

It should further be noted that, with locking tang 235 protruding through window 261, anti-tampering projection 253 extends up to inner surface 227 of outer end wall 225. As such, anti-tampering projection 253 forms a barrier, or enclosure, between top surface 249 of strap 215 and inner surface 227 of outer end wall 125, thereby rendering locking tang 235 less susceptible to tampering, which is highly desirable.

Although highly useful, ties 111 and 211 suffer from a notable drawback. Specifically, with tie 111 formed into its closed loop configuration, locking tang 135 is susceptible to tampering through strap exit end 133 between bottom surface 151 of strap 115 and inner surface 127 of inner end wall 126, as shown in FIG. 7(*c*). Similarly, with tie 211 formed into its closed loop configuration, locking tang 235 is susceptible to tampering through strap exit end 233 between bottom surface 251 of strap 215 and inner surface 227 of inner end wall 226, as shown in FIG. 10.

Accordingly, referring now to FIGS. 11–15, there is provided another embodiment of a tie constructed according to the teachings of the present invention, the tie being identified generally by reference numeral 311. As will be described further in detail below, the particular construction of tie 311 renders it less susceptible to tampering than ties 11, 111 and 211, which is highly desirable.

Preferably, tie 311 is of the type which can be used in high strength applications, such as to secure the cover of a pharmaceutical tote box or food supply container in a closed position during shipping. However, tie 311 is not limited to tote box applications. Rather, it is to be understood that tie 311 could be used in alternative applications, such as in truck seal, merchandise pairing and/or ski tag applications, without departing from the spirit of the present invention.

Tie 311 comprises a head 313 and an attached strap 315. Preferably, tie 311 is formed as a single piece and is constructed of nylon using conventional molding techniques. As can be appreciated, tie 311 preferably has a minimum tensile strength of 80 lbs.

Head 313 is generally rectangular in shape and comprises a bottom wall 317, a top wall 319, a first sidewall 321, a second sidewall 323, an outer end wall 325 and an inner end wall 326. First sidewall 321, second sidewall 323, outer end wall 325 and inner end wall 326 together define an inner surface 327 for head 313, an outer surface 328 for head 313 and an elongated interior channel 329 which extends longitudinally through head 313 from bottom wall 317 to top wall 319, elongated interior channel 329 having a strap entry end 331 formed in bottom wall 317 and a strap exit end 333 formed in top wall 319.

It should be noted that the lateral cross-sectional area of interior channel 329 is relatively small in size so as to render tie 311 less susceptible to tampering, which is highly desirable.

Figure 12:
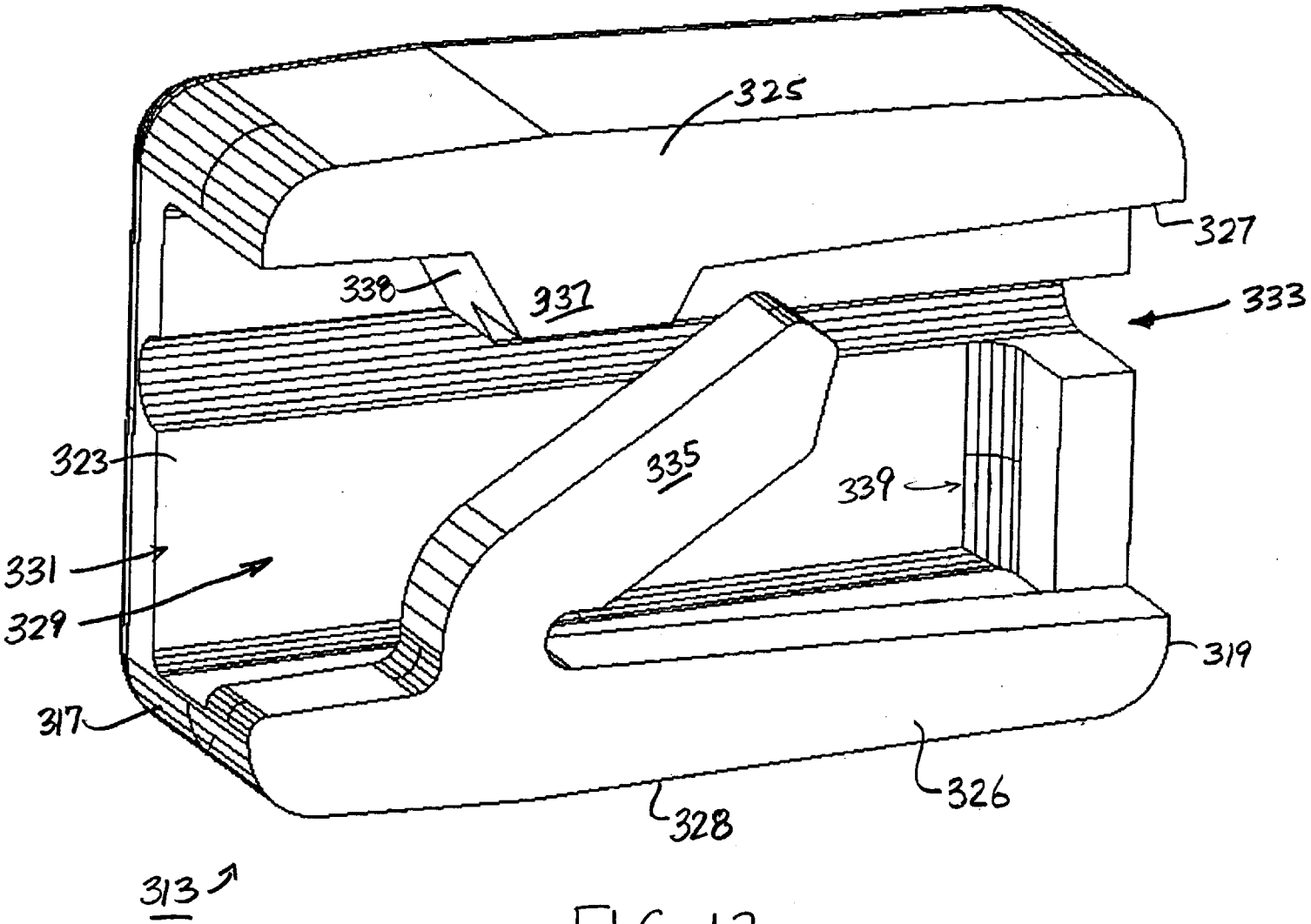
FIG. 12 is an enlarged, left side perspective view of the tie shown in FIG. 11, taken along lines 12—12.

Referring now to FIG. 12, head 313 also comprises a locking tang 335 which is integrally formed onto inner surface 327 of inner end wall 326 and which projects into interior channel 329. Preferably, locking tang 335 is of the deflectable type which is capable of articulation. However, it is to be understood that locking tang 335 could alternatively be of the stationary type which is incapable of articulation without departing from the spirit of the present invention.

Head 313 further comprises a strap limiting stop 337 which is integrally formed onto inner surface 327 of outer end wall 325 and which projects into interior channel 329. Stop 337 is fixedly formed onto outer end wall 325 and includes a flat abutment surface 338.

It should be noted that locking tang 335 and strap limiting stop 337 are both spaced adequately away from bottom wall 317 and top wall 319, as shown in FIG. 12. As will be described further in detail below, spacing locking tang 335 and strap limiting stop 337 adequately away from bottom wall 317 renders tie 311 less susceptible to tampering, which is highly desirable.

Head 313 additionally comprises a generally arcuate door activation surface 339 which, in use, serves to facilitate enclosing exit end 333, thereby rendering tie 311 less susceptible to tampering, as will be described further in detail below. Door activation surface 339 is formed on inner surface 327 of head 313 along a portion of top wall 319, second sidewall 323 and inner end wall 326. However, it is to be understood that door activation surface 339 could be formed on inner surface 327 at alternative locations within head 313 without departing from the spirit of the present invention.

Strap 315 comprises a first end 341 and a second end 343. First end 341 is integrally formed on head 313 so as to render tie 311 a unitary device.

Strap 315 also comprises a strap limiting projection 345 which is formed between first end 341 and second end 343. Strap limiting projection 345 extends out from both sides of strap 315 and is generally rectangular in longitudinal and lateral cross-section, strap limiting projection 345 comprising an upper abutment surface 346-1 and a lower abutment surface 346-2. As will be described further in detail below, projection 345 serves to limit the degree to which strap 315 can be advanced through interior channel 329 of head 313.

The portion of strap 315 from projection 345 to first end 341 is in the form of an elongated, flexible, high strength, filament 347. Filament 347 preferably includes a generally uniform, rectangularly-shaped lateral cross-section. However, it is to be understood that filament 347 could be constructed in alternative sizes and shapes without departing from the spirit of the present invention.

The portion of strap 315 from projection 345 to second end 343 comprises a substantially flat top surface 349 and a substantially flat bottom surface 351.

Figure 14:
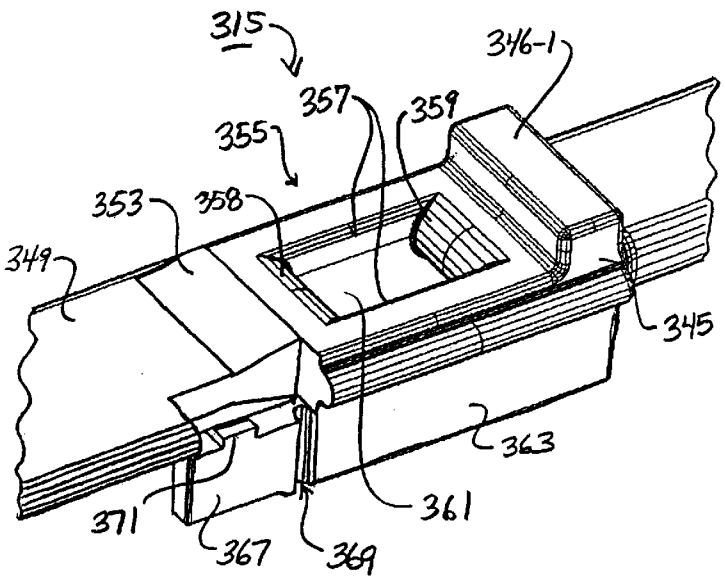
FIG. 14 is an enlarged, fragmentary, bottom perspective view of the tie shown in FIG. 11.
Figure 15A:
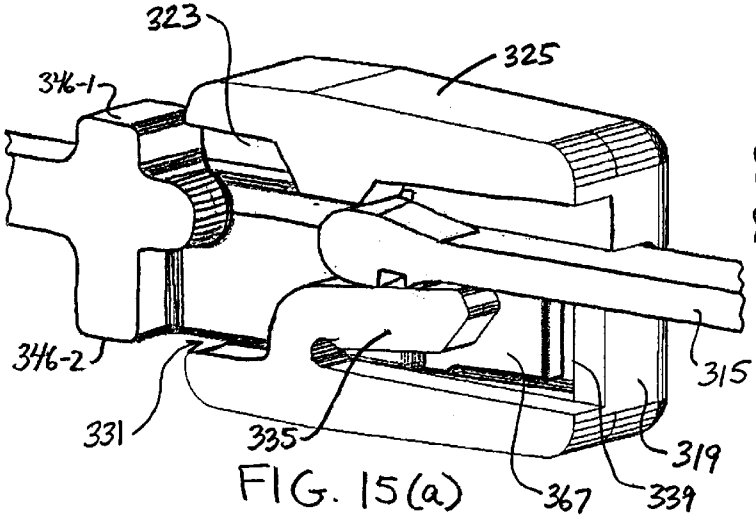
FIGS. 15(*a*)–15(*d*) represent a series of fragmentary, left side perspective views of the tie shown in FIG. 11 as the strap is inserted through the head.
Figure 15B:
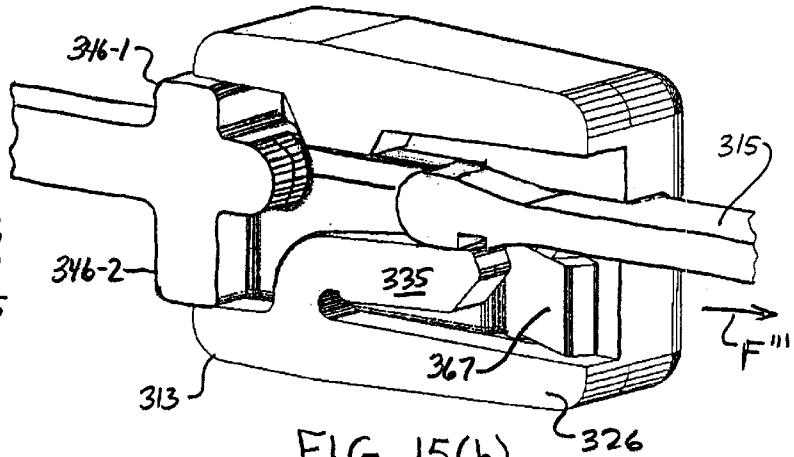
Figure 15C:
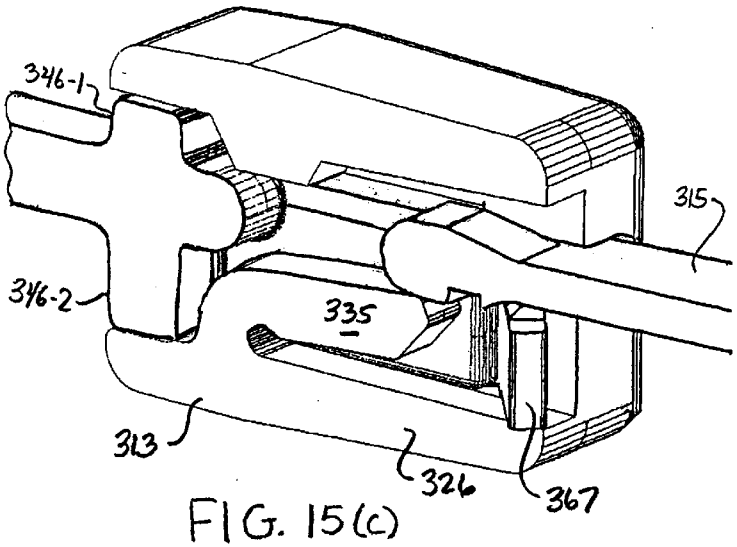
Figure 15D:
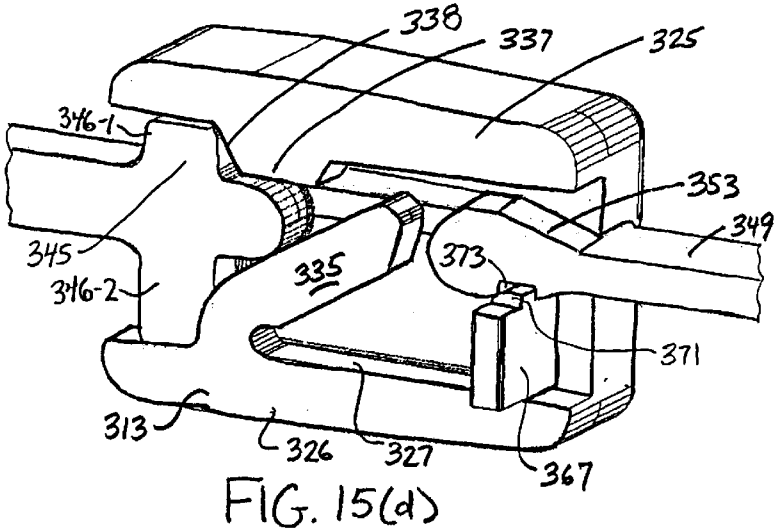

Referring now to FIG. 14, an anti-tampering projection 353 is formed on top surface 349 of strap 315 between projection 345 and second end 343, anti-tampering projection 353 being in the form of a ramp which is triangular in longitudinal cross-section. As can be appreciated, anti-tampering projection 353 protrudes up from top surface 349 to render locking tang 335 less susceptible to tampering during use, as will be described further in detail below.

The portion of strap 315 from projection 345 to second end 343 further comprises a ladder structure 355 which is substantially thicker than the remainder of strap 315 for strengthening purposes. Specifically, ladder structure 355 comprises a pair of thickened side rails 357, an outer rung 358 formed on anti-tampering projection 353 and an inner rung 359 which extends laterally between side rails 357. Together, side rails 357, rung 358 and rung 359 define a rectangular opening, or window, 361.

It should be noted that strap 315 it is not limited to the inclusion of opening 361. Rather, opening 361 could be replaced with a thin wall, or membrane, which lies entirely between top surface 349 and bottom surface 351 without departing from the spirit of the present invention.

Figure 13:
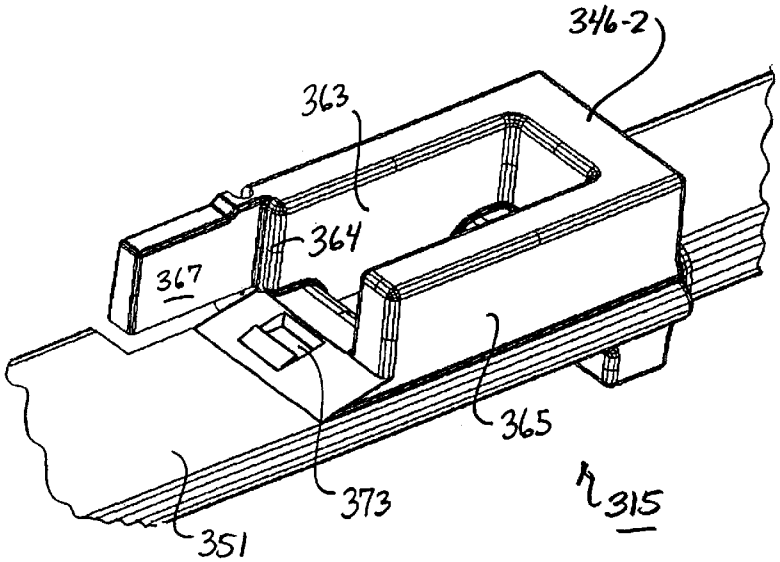
FIG. 13 is an enlarged, fragmentary, bottom perspective view of the tie shown in FIG. 11.

Referring now to FIG. 13, first and second sidewalls 363 and 365 are formed on bottom surface 351 of strap 315 on opposite sides of window 361. Specifically, sidewalls 363 and 365 are integrally formed onto and lie flush with lower abutment surface 346-2 of strap limiting projection 345. As can be appreciated, sidewalls 363 and 365 serve to strengthen tie 311 in use.

A pivotally mounted door 367 is integrally formed onto free end 364 of sidewall 363. Door 367 is formed onto sidewall 363 through an elongated groove 369. Groove 369 serves as a hinge about which door 367 is capable of being pivoted between an open position, in which door 367 lies in parallel with sidewall 363, and a closed position, in which door 367 lies perpendicular with sidewall 363, as will be described further in detail below.

Door 367 further includes a latch 371, as shown in FIG. 14. Latch 371 is sized and shaped to project into a latch recess 373 which is formed in strap 315 between sidewalls 363 and 365 when door 367 is disposed into its closed position. Specifically, as door 367 pivots towards opposite sidewall 363, latch 371 protrudes into recess 373, thereby locking door 367 in its closed position, door 367 extending perpendicularly between sidewalls 363 and 365, as will be described further in detail below.

Referring now to FIGS. 15(*a*)–15(*d*), tie 311 can be used to secure a tote box in a closed position in the following manner. First, strap 315 is wrapped around the tote box handle, thereby securing the tote box in its closed position. Second end 343 of strap 315 is then inserted in through strap entry end 331 of elongated interior channel 329 so that tie 311 forms a closed loop, as shown in FIG. 15(*a*). It should be noted that door 367 is originally disposed in its open position, door 367 lying parallel with second sidewall 323.

Referring now to FIGS. 15(*b*) and 15(*c*), as strap 315 is advanced in the forward direction through interior channel 329, as represented by arrow F'''', locking tang 335 pivots down towards inner end wall 326 to enable strap 315 to pass through head 313. It should be noted that door 367 eventually contacts against curved door activation surface 339. As a consequence, curved surface 339 pivots door 367 about groove 369 from its open position to its closed position, such that door 367 begins to extend towards sidewall 365.

Referring now to FIG. 15(*d*), continued advancement of strap 315 in the forward direction eventually causes locking tang 335 to pivot back up and protrude through window 361, thereby locking tie 311 in its closed loop configuration. Furthermore, door 367 continues to pivot about groove 369 until latch 371 extends into recess 373, thereby locking door 367 in its closed perpendicular position between sidewalls 363 and 365.

It should be noted that, with locking tang 335 protruding through window 361, projection 345 abuts against strap limiting stop 337 and locking tang 335, thereby limiting further forward advancement of strap 315 through head 313. Specifically, as shown in FIG. 15(*d*), upper abutment surface 346-1 of projection 345 contacts abutment surface 338 of stop 337 and lower abutment surface 346-2 contacts locking tang 335 at its conjunction with inner surface 327 of inner end wall 326. As can be appreciated, projection 345 not only limits the forward advancement of strap 315 through head 313 but also, in conjunction with strap 315, serves as a wall for enclosing strap entry end 331 of head 313, thereby rendering tie 311 less susceptible to tampering, which is highly desirable. Because projection 345 abuts against abutment surface 338 and locking tang 335 at a distance spaced adequately in from strap entry end 331, locking tang 335 is less susceptible to tampering than if projection 345 were to abut against outer surface 328 of bottom wall 317.

It should further be noted that, with locking tang 335 protruding through window 361, anti-tampering projection 353 extends up towards inner surface 327 of outer end wall 325. Specifically, anti-tampering projection 353 extends considerably closer to outer end wall 325 than the tip of locking tang 335. As such, anti-tampering projection 353 forms a barrier at strap exit end 333 between top surface 349 of strap 315 and inner surface 327 of outer end wall 325 which renders locking tang 335 less susceptible to tampering, which is highly desirable. Furthermore, with door 367 disposed in its closed position, strap 315 is unable to be displaced down towards inner end wall 326 so that anti-tampering projection 353 lies beneath the tip of locking tang 335, which is highly desirable.

It should additionally be noted that, with locking tang 335 protruding through window 361, door 367 is locked in its closed perpendicular position between first and second sidewalls 321 and 323. Disposed in its closed position, door 367 forms a barrier at strap exit end 333 between bottom surface 351 of strap 315 and inner surface 327 of inner end wall 326.

As can be appreciated, strap 315, anti-tampering projection 353 and door 367 together close off strap exit end 333 of head 313, thereby rendering locking tang 335 less susceptible to tampering, which is highly desirable.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A tie comprising:

(a) a head which is shaped to include an elongated interior channel therethrough, said head comprising a bottom wall, a top wall, a first sidewall, a second sidewall, an outer end wall and an inner end wall, said elongated interior channel extending through said head from the bottom wall to the top wall, said head comprising a strap limiting stop and a locking tang which are both disposed to project into the elongated interior channel, the locking tang and the strap limiting stop being spaced adequately in from the bottom wall and the top wall, and (b) a strap having a first end and a second end, the first end being integrally formed onto said head, said strap being sized and shaped to be inserted into the elongated interior channel so said tie forms a closed loop, wherein increased insertion of said strap into the elongated interior channel decreases the size of the closed loop, said strap including a strap limiting projection formed thereon between the first end and the second end, wherein, with the tie formed into a closed loop, said strap limiting projection abuts against the stop formed in said head to limit further insertion of said strap into said head, (c) the portion of said strap from the strap limiting projection to the second end including a top surface and a bottom surface, the portion of said strap from said strap limiting projection to the second end being adapted to be engaged by said locking tang when said tie is formed into a closed loop, wherein an anti-tampering projection is integrally formed on the top surface of the portion of said strap between said strap limiting projection and the second end, (d) wherein, with the tie formed into a closed loop and with said strap limiting projection abutting against the stop formed in said head, said strap limiting projection is sized and shaped to substantially enclose the elongated interior channel of said head at the bottom end and said anti-tampering projection is sized and shaped to substantially enclose the interior channel at the top end of said head between said strap and the outer end wall.

2. A tie comprising:

(a) a head which is shaped to include an elongated interior channel therethrough, said head comprising a bottom wall, a top wall, a first sidewall, a second sidewall, an outer end wall and an inner end wall, said elongated interior channel extending through said head from the bottom wall to the top wall, said head comprising a strap limiting stop and a locking tang which are both disposed to project into the elongated interior channel, the locking tang and the strap limiting stop being spaced adequately in from the bottom wall and the top wall, and (b) a strap having a first end and a second end, the first end being integrally formed onto said head, said strap being sized and shaped to be inserted into the elongated interior channel so said tie forms a closed loop, wherein increased insertion of said strap into the elongated interior channel decreases the size of the closed loop, said strap including a strap limiting projection formed thereon between the first end and the second end, wherein, with the tie formed into a closed loop, said strap limiting projection abuts against the stop formed in said head to limit further insertion of said strap into said head, (c) the portion of said strap from the strap limiting projection to the second end including a top surface and a bottom surface, the portion of said strap from said strap limiting projection to the second end being adapted to be engaged by said locking tang when said tie is formed into a closed loop, wherein an anti-tampering projection is integrally formed on the top surface of the portion of said strap between said strap limiting projection and the second end, (d) wherein, with the portion of said strap from said strap limiting projection to the second end engaged by said locking tang, said strap is sized and shaped such that the second end of said strap is disposed entirely within said head, (e) wherein, with the tie formed into a closed loop and with said strap limiting projection abutting against the stop formed in said head, said strap limiting projection is sized and shaped to substantially enclose the interior channel at the top end of said head between said strap and the outer end wall.

3. A tie comprising:

(a) a head which is shaped to include an elongated interior channel therethrough, said head comprising a locking tang which is disposed to project into the elongated interior channel, and (b) a strap having a first end and a second end, the first end being integrally formed onto said head, said strap being sized and shaped to be inserted into the elongated interior channel so said tie forms a closed loop, wherein increased insertion of said strap into the elongated interior channel decreases the size of the closed loop, said strap including a strap limiting projection formed thereon between the first end and the second end, said strap limiting projection limiting the minimum size of the closed loop which can be formed, (c) the portion of said strap from said strap limiting projection to the second end including a top surface and a bottom surface, the portion of said strap from said strap limiting projection to the second end being adapted to be engaged by said locking tang when said tie is formed into a closed loop, (d) wherein an anti-tampering projection is formed on the top surface of the portion of said strap from said strap limiting projection to the second end, (e) wherein a door is formed on the bottom surface of the portion of said strap from the strap limiting projection to the second end, said door being adapted to pivot between an open position and a closed position.

4. The tie of claim 3 wherein said head comprises a bottom wall, a top wall, a first sidewall, a second sidewall, an outer end wall and an inner end wall, said elongated interior channel extending through said head from the bottom wall to the top wall.

5. The tie of claim 4 wherein said head comprises a strap limiting stop which is disposed to project into the elongated interior channel and a door activation surface.

6. The tie of claim 5 wherein said door comprises a latch which is sized and shaped to project into a latch recess formed in the bottom surface of said strap when said door is disposed in its closed position.

7. The tie of claim 6 wherein the door activation surface is disposed such that, as said strap is inserted into said head, the door activation strap urges the door from its open position to its closed position.

8. The tie of claim 7 wherein, with said tie formed into a closed loop and with said door disposed into its closed position, said door is sized and shaped to substantially enclose the interior channel of said head at the top wall between said strap and the inner end wall.

9. The tie of claim 8 wherein, with said tie formed into a closed loop and with said door disposed into its closed position, the anti-tampering projection is sized and shaped to substantially enclose the elongated interior channel of said head at the top wall between said strap and the outer end wall.

10. The tie of claim 9 wherein, with said strap inserted into the elongated interior channel to form a closed loop, said strap limiting projection is sized and shaped to abut against the stop formed in said head to limit the insertion of said strap through the interior channel of said head and said strap limiting projection is sized and shaped to substantially enclose the elongated interior channel of said head at the bottom end.

11. The tie of claim 10 wherein the locking tang and the strap limiting stop are spaced adequately in from the bottom wall and the top wall.

12. The tie of claim 11 wherein the portion of said strap from the projection to the second end comprises a ladder structure which is engagable by said locking tang when said strap is inserted into the elongated channel to form a closed loop, said ladder structure comprising a window.

* * * * *